US009471030B2

(12) United States Patent
Sato et al.

(10) Patent No.: US 9,471,030 B2
(45) Date of Patent: Oct. 18, 2016

(54) IMAGE FORMING APPARATUS INCLUDING PHOTOSENSITIVE DRUM AND EXPOSING MEMBER MOVABLE BETWEEN EXPOSURE POSITION CLOSE TO DRUM AND SEPARATED POSITION SEPARATED FROM THE DRUM

(71) Applicant: Brother Kogyo Kabushiki Kaisha, Nagoya-shi, Aichi-ken (JP)

(72) Inventors: Shougo Sato, Seto (JP); Yosuke Aoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/529,971

(22) Filed: Oct. 31, 2014

(65) Prior Publication Data

US 2015/0050043 A1 Feb. 19, 2015

Related U.S. Application Data

(63) Continuation of application No. 13/623,988, filed on Sep. 21, 2012, now Pat. No. 8,879,950.

(30) Foreign Application Priority Data

Dec. 26, 2011 (JP) ..... 2011-284468

(51) Int. Cl.
*G03G 15/00* (2006.01)
*G03G 21/16* (2006.01)
(Continued)

(52) U.S. Cl.
CPC ..... *G03G 21/1661* (2013.01); *G03G 21/1633* (2013.01); *G03G 21/1666* (2013.01); *G03G 21/185* (2013.01)

(58) Field of Classification Search
CPC ..... G03G 21/1642; G03G 21/1623; G03G 21/1638; G03G 21/1661; G03G 21/185; G03G 21/1839; G03G 21/1842; B41J 2/435
See application file for complete search history.

(56) References Cited

U.S. PATENT DOCUMENTS 6,978,103 B2 12/2005 Miura et al.
8,427,519 B2 4/2013 Umezawa
(Continued)

FOREIGN PATENT DOCUMENTS

JP 2001-175046 A 6/2001
JP 2002182539 A 6/2002
(Continued)

OTHER PUBLICATIONS

Oct. 13, 2015—(JP) Notification of Reason for Refusal—App 2011-284468, Eng Tran.

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image forming apparatus includes: a main apparatus body; an opening/closing member; a drum unit including a photosensitive drum and can be pulled out of an accommodating space along an axial direction of the photosensitive drum; an exposing member provided in the main apparatus body and movable between an exposure position and an evacuation position; and a movable mechanism including: a first movable member movable in accordance with an opening/closing operation of the opening/closing member; and a second movable member for moving the exposing member between the exposure position and the evacuation position in accordance with movement of the first movable member. The second movable member supports both end portions of the exposing member. The second movable member moves the exposing member to the exposure position or the evacuation position by the movement of the first movable member in accordance with the movement of the opening/closing member.

15 Claims, 5 Drawing Sheets

(51) Int. Cl.
*G03G 21/18* (2006.01)
*B41J 2/435* (2006.01)

(56) References Cited

U.S. PATENT DOCUMENTS

2008/0145103 A1* 6/2008 Honobe ..... G03G 15/04054 399/205
2009/0269101 A1 10/2009 Okabe et al.
2010/0021200 A1 1/2010 Kato
2011/0050834 A1 3/2011 Umezawa
2011/0299873 A1* 12/2011 Ushiozu ..... G03G 15/04054 399/90

FOREIGN PATENT DOCUMENTS

JP 2006-258909 A 9/2006
JP 2006263985 A 10/2006
JP 2009237368 A 10/2009
JP 2011-070143 A 4/2011
JP 2011070142 A 4/2011
WO 2011024491 A1 3/2011

* cited by examiner

IMAGE FORMING APPARATUS INCLUDING PHOTOSENSITIVE DRUM AND EXPOSING MEMBER MOVABLE BETWEEN EXPOSURE POSITION CLOSE TO DRUM AND SEPARATED POSITION SEPARATED FROM THE DRUM

CROSS-REFERENCE TO RELATED APPLICATIONS

This application is a continuation of prior U.S. application ser. No. 13/623,988, filed Sep. 21, 2012, which claims priority from Japanese Patent Application No. 2011-284468filed on Dec. 26, 2011, the entire subject matter of which is incorporated herein by reference.

TECHNICAL FIELD

The present invention relates to an image forming apparatus using an electrophotographic method.

BACKGROUND

As an example of electrophotographic image forming apparatuses, there have been known an image forming apparatus including a main apparatus body, a photosensitive drum, a processing cartridge mountable to and removable from the main apparatus body along the axial direction of the photosensitive drum, and an LED array head for exposing the photosensitive drums. In this image forming apparatus, when the processing cartridge is mounted to or removed from the main apparatus body, it is necessary to prevent interference between the processing cartridge and the LED array head. To this end, various configurations for evacuating the LED array heads have been considered.

For example, there have been proposed an image forming apparatus including a holding member that holds LED array heads and is movable in a vertical direction, and a bracket that is disposed to be adjacent to the holding member in the axial direction of photosensitive drums and is linearly movable in a direction perpendicular to both of the axial direction of the photosensitive drums and the vertical direction. In this related-art image forming apparatus, pins protruding along the axial direction of the photosensitive drums are provided at the holding member, and guide holes having tapered portions inclined diagonally upward are formed at the bracket.

In this related-art image forming apparatus, in accordance with linear movement of the bracket, the pins of the holding member are guided along the inclination of the tapered portions of the bracket, and the holding member is moved to advance or evacuate such that the LED array heads are moved between first positions where the LED array heads are close to the photosensitive drums and second positions where the LED array heads are evacuated from the photosensitive drums.

SUMMARY

However, in the above-described related-art image forming apparatus disclosed in Japanese Patent Application Laid-Open No. 2001-175046, in accordance with the linear movement of the bracket, the pins of the holding member are guided by the tapered portions of the bracket, whereby the LED array heads are moved between the first positions and the second positions. To this end, it is necessary to secure a linear movement distance for the bracket corresponding to the amount of displacement of the LED array heads. Since it is necessary to secure the linear movement distance, it is difficult to reduce a size the image forming apparatus.

Therefore, illustrative aspects of the present invention provide an image forming apparatus capable of securing certain movement of exposing members with reducing a size of the apparatus.

According to one illustrative aspect of the present invention, there is provided an image forming apparatus comprising: a main apparatus body having an accommodating space partitioned therein and an opening configured to connect the accommodating space and an outside; an opening/closing member provided at the main apparatus body and configured to move between an open position for opening the opening and a closed position for closing the opening; a drum unit comprising a photosensitive drum configured to carry a developer image and accommodated in the accommodating space, wherein the drum unit is configured to be pulled out of the accommodating space along an axial direction of the photosensitive drum; an exposing member provided in the main apparatus body and configured to move between an exposure position, which is close to the photosensitive drum for exposing the photosensitive drum, and an evacuation position where the exposing member evacuates from the photosensitive drum; and a movable mechanism. The movable mechanism comprises: a first movable member configured to move in accordance with an opening/closing operation of the opening/closing member; and a second movable member configured to move the exposing member between the exposure position and the evacuation position in accordance with movement of the first movable member. The second movable member is configured to support both end portions of the exposing member. The second movable member is configured to move the exposing member from the exposure position to the evacuation position by the movement of the first movable member in accordance with the movement of the opening/closing member from the closed position to the open position. The second movable member is configured to move the exposing member from the evacuation position to the exposure position by the movement of the first movable member in accordance with the movement of the opening/closing member from the open position to the closed position.

DETAIL DESCRIPTION

Exemplary embodiments of the present invention will now be described with reference to the drawings.

1 . Overall Configuration of Printer

Figure 1:
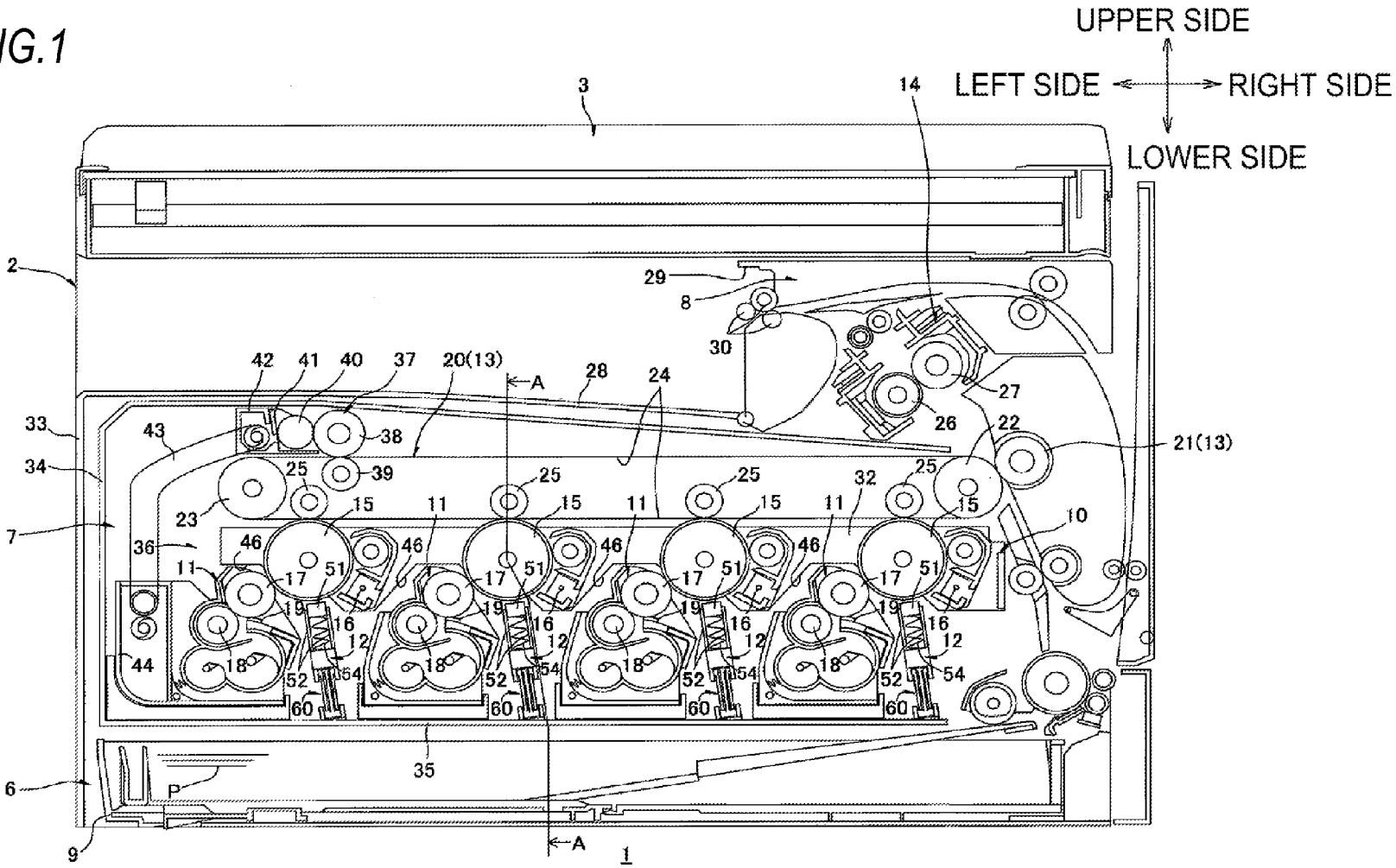
FIG. 1 is a center section view illustrating a color printer as one example of an image forming apparatus according to an exemplary embodiment of the present invention.
Figure 2:
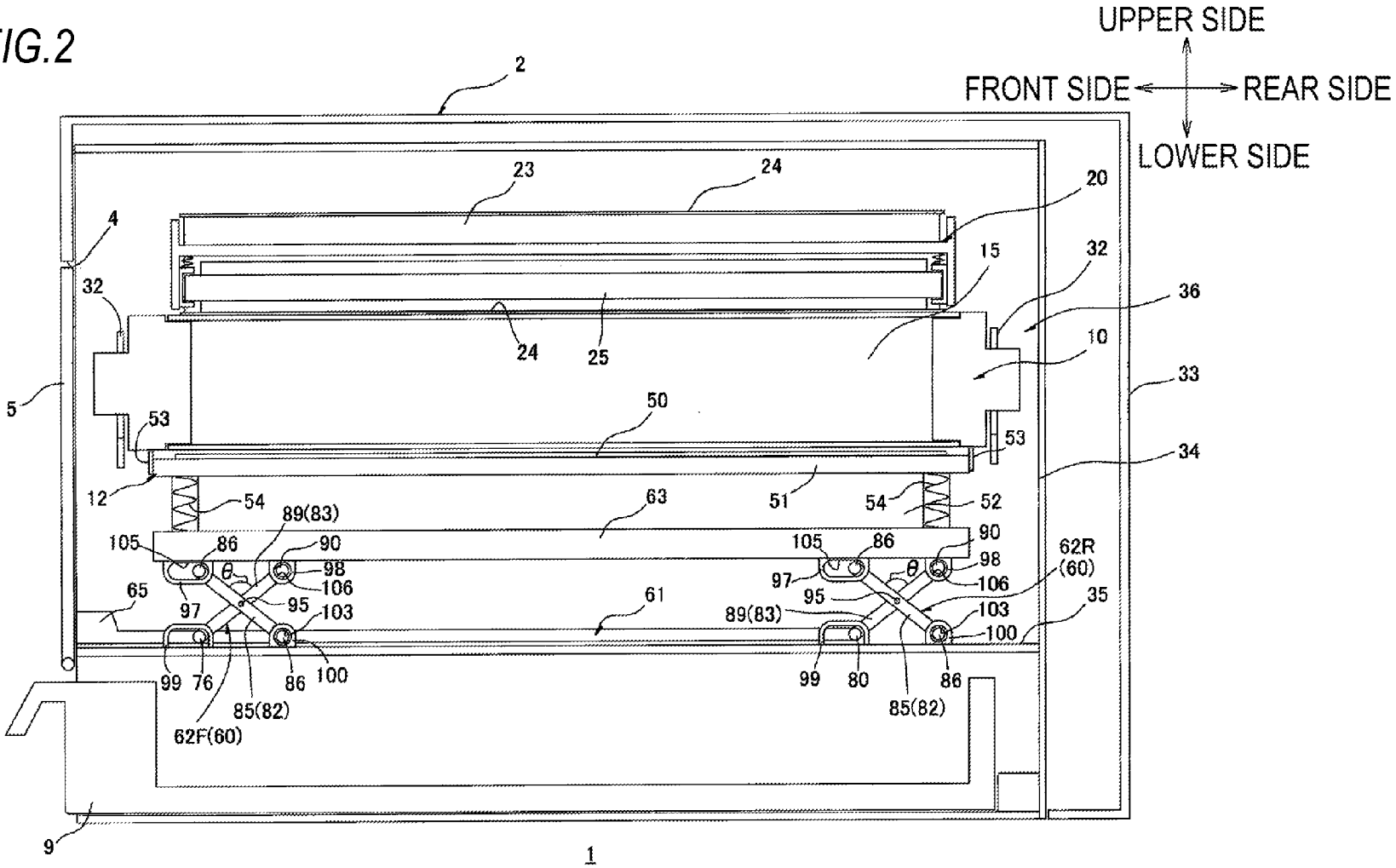
FIG. 2 is a cross-sectional view illustrating the color printer shown in FIG. 1 as taken along a line A-A.

As shown in FIGS. 1 and 2, a printer 1 (one example of an image forming apparatus) is an intermediate transfer type color printer.

The printer 1 is a multi-function apparatus integrally includes a main body casing 2 (one example of a main apparatus body) and a flatbed scanner 3 configured to read image information of a document.

(1) Main Body Casing

The main body casing 2 is formed in a substantially box shape. At one side wall of the main body casing 2, a main opening 4 (one example of an opening) is formed. The main body casing 2 is provided such that a front cover 5 (one example of an opening/closing member) for opening and closing the main opening 4 is swingable (e.g., movable) between a closed position (see FIG. 2) for closing the main opening 4 and an open position (see FIGS. 5A and 5B) for opening the main opening 4 around an lower end portion thereof.

In the following description, the front cover (5) side (e.g., the left side on the drawing paper of FIG. 2) is the front side of the printer 1, and the opposite side (e.g., the right side on the drawing paper of FIG. 2) to the front cover (5) side is the rear side of the printer 1. The left and right sides of the drawings refer to the left and right sides of the printer 1 as seen from a user facing the printer 1.

That is, in FIG. 1, the left side of the drawing paper is the left side of the printer, and the right side of the drawing paper is the right side of the printer. Further, a direction from the drawing paper toward a viewer is the front side of the printer, and a direction from the drawing paper toward the opposite side to the viewer side is the rear side of the printer.

The main body casing 2 includes a sheet feeding unit 6 for feeding sheet P, an image forming unit 7 for forming an image on the fed sheet P, and a discharging unit 8 for discharging the sheet P having an image formed thereon.

(2) Sheet Feeding Unit

The sheet feeding unit 6 is provided at the bottom of the main body casing 2. The sheet feeding unit 6 includes a sheet feed tray 9 which is for accommodating sheets P (see FIG. 5A) and is mountable and removable.

Sheets P in the sheet feed tray 9 are conveyed by various rollers one at a time. The sheet P is fed into the image forming unit 7 (between an intermediate transfer belt 24 (to be described below) and a secondary transfer roller 21 (to be described below)) at a predetermined timing.

(3) Image Forming Unit

The image forming unit 7 is disposed on the sheet feeding unit 6. The image forming unit 7 includes a drum unit 10, a plurality of (e.g., four) developing units 11, a plurality of (e.g., four) LED units 12, a transfer unit 13, and a fixing unit 14.

(3-1) Drum Unit

The drum unit 10 is mounted to the main body casing 2 and is configured to be pulled out along the front/rear direction.

The drum unit 10 includes a pair of drum frames 32, photosensitive drums 15, and scorotron chargers 16.

The paired drum frames 32 are formed in substantially flat plate shapes extending in the left/right direction and face each other with a gap in the front/rear direction.

At the lower portions of the drum frames 32, mount/removal grooves 46 are formed corresponding to the plurality of developing units 11.

The drum frames 32 are projected in the front/rear direction, and portions of the drum frames 32 overlapping the upper end portions of the developing units 11 during the projection are cut off, whereby the mount/removal grooves 46 are formed.

A plurality of (e.g., four) photosensitive drums 15 are provided corresponding to multiple colors (e.g., black, yellow, magenta, and cyan), and are arranged in parallel with intervals in the left/right direction.

The photosensitive drums 15 are formed in substantially cylindrical shapes extending in the front/rear direction (e.g., axial direction), and the front and rear end portions of the photosensitive drums 15 are supported to by the pair of drum frames 32, such that the photosensitive drums 15 are rotatable.

The scorotron chargers 16 are provided corresponding to the plurality of photosensitive drums 15, and are supported by the drum frames 32 such that the scorotron chargers 16 face the photosensitive drums 15 from the right sides of the photosensitive drums 15 with gaps.

(3-2) Developing Unit

Each of the plurality of developing units 11 is disposed to face the lower left side of a corresponding photosensitive drum 15. Each of the developing units 11 includes a corresponding developing roller 17.

The developing rollers 17 are supported at the upper ends of the developing units 11 such that the developing rollers 17 are rotatable and are exposed from their upper sides, and are in contact with corresponding photosensitive drums 15 of the drum unit 10 from their lower left sides.

Incidentally, the developing units 11 include feed rollers 18 for feeding toner to the developing rollers 17, and layer-thickness regulating blades 19 for regulating the thicknesses of fed toner on the developing rollers 17. In the developing units 11, toner (one example of developer) is accommodated in the lower sides of the feed rollers 18.

From among the plurality of developing units 11, the leftmost developing unit 11 includes a waste-toner accommodating unit 44 for accommodating toner (waste toner) remaining on the surface of the intermediate transfer belt 24 (to be described below).

(3-3) LED Unit

Each of the plurality of LED units 12 is disposed on the lower side of a corresponding photosensitive drum 15 such that a corresponding LED unit 12 faces the corresponding photosensitive drum 15 in the vertical direction. The LED units 12 expose the surfaces of the corresponding photosensitive drums 15 on the basis of predetermined image data.

(3-4) Transfer Unit

The transfer unit 13 includes a belt unit 20 and a secondary transfer roller 21.

The belt unit 20 is disposed along the left/right direction such that the belt unit 20 faces all of the photosensitive drums 15 from the upper sides of the photosensitive drums 15.

The belt unit 20 includes a drive roller 22, a driven roller 23, the intermediate transfer belt 24, and a plurality of (e.g., four) primary transfer rollers 25, and a belt cleaner 37.

The drive roller 22 and the driven roller 23 are disposed to face each other in the left/right direction with a gap therebetween.

The intermediate transfer belt 24 is wound around the drive roller 22 and the driven roller 23 such that the lower portion of the intermediate transfer belt 24 comes into contact with all of the photosensitive drums 15. The intermediate transfer belt 24 goes around in accordance with the driving of the drive roller 22 and the following of the driven roller 23 such that the lower portion of the intermediate transfer belt 24 moves from the left side to the right side.

Each of the primary transfer rollers 25 is disposed to face a corresponding photosensitive drum 15 with the lower portion of the intermediate transfer belt 24 interposed therebetween.

The belt cleaner 37 is provided on the upper side of the left end portion of the intermediate transfer belt 24. The belt cleaner 37 includes a belt cleaning roller 38, a facing roller 39, a relay roller 40, a scraping blade 41, and a waste-toner retaining unit 42.

Toner remaining on the surface of the intermediate transfer belt 24 (e.g., waste toner) is held by the belt cleaning roller 38, is held by the relay roller 40, is scraped by the scraping blade 41, and is retained in the waste-toner retaining unit 42. The waste-toner retaining unit 42 is connected to the waste-toner accommodating unit 44 through a conveyance pipe 43. The waste toner retained in the waste-toner retaining unit 42 is transferred into the waste-toner accommodating unit 44 through the conveyance pipe 43.

The secondary transfer roller 21 is provided on the right side of the belt unit 20 such that the secondary transfer roller 21 faces the drive roller 22 of the belt unit 20 with the intermediate transfer belt 24 interposed therebetween.

(3-5) Fixing Unit

The fixing unit 14 is disposed on the upper side relative to the secondary transfer roller 21. The fixing unit 14 includes a heating roller 26, and a pressing roller 27 facing the heating roller 26.

(3-6) Image Forming Operation (3-6-1) Developing Operation

Toner in the developing units 11 is fed onto the feed rollers 18, and then is fed onto the developing rollers 17.

The rotation of the developing rollers 17 causes friction between the developing rollers 17 and the feed rollers 18, which charges the fed toner on the developing rollers 17 to have positive polarity. The positively charged toner on the developing rollers 17 is regulated by the layer-thickness regulating blades 19 such that the toner is carried as thin layers of a constant thickness on the surfaces of the developing rollers 17.

In accordance with the rotation of the photosensitive drums 15, the surfaces of the photosensitive drums 15 are uniformly and positively charged by the scorotron chargers 16, and are exposed by the LED units 12. Therefore, electrostatic latent images corresponding to an image to be formed on a sheet P are formed on the surfaces of the photosensitive drums 15.

When the photosensitive drums 15 further rotate, the toner carried on the surfaces of the developing rollers 17 is fed onto the electrostatic latent images of the photosensitive drums 15. Therefore, on the surfaces of the photosensitive drums 15, toner images based on reversal development are carried.

(3-6-2) Transferring and Fixing Operations

The toner images carried on the surfaces of the photosensitive drums 15 are primarily transferred onto the lower portion of the intermediate transfer belt 24 moving from the left side to the right side.

The transferred toner images on the intermediate transfer belt 24 are secondarily transferred onto a sheet P fed from the sheet feeding unit 6 while the sheet P passes a position where the intermediate transfer belt 24 faces the secondary transfer roller 21.

Then, while the sheet P passes between the heating roller 26 and the pressing roller 27, the transferred toner image on the sheet P is thermally fixed to the sheet P by heat and a pressure in the fixing unit 14.

(4) Discharging Unit

At the top of the main body casing 2, a discharge tray 28 onto which sheets P are discharged is formed. The discharging unit 8 is formed at the upper right end portion of the main body casing 2 such that the discharging unit 8 protrudes toward the upper side relative to the discharge tray 28.

At the upper portion of the discharging unit 8 relative to the discharge tray 28, a discharging port 29 for discharging sheets P is formed. The discharging unit 8 includes a plurality of (e.g., three) discharging rollers 30, which is provided inside the discharging port 29 and is for discharging sheets P onto the discharge tray 28.

The sheet P having the toner image fixed thereon in the fixing unit 14 is discharged onto the discharge tray 28 by the discharging rollers 30.

(5) Flatbed Scanner

The flatbed scanner 3 is supported with a gap from the upper side of the discharge tray 28 by the upper end portion of the discharging unit 8.

2 . Main Body Casing

As shown in FIG. 2, the main body casing 2 includes an outer casing 33 forming the appearance of the printer 1, and an inner casing 34 provided on the internal side of the outer casing 33.

The outer casing 33 is formed in a substantially box shape which is substantially rectangular in a side view. The front cover 5 is provided at the front end portion of the outer casing 33.

The inner casing 34 is formed in a substantially box shape which is substantially rectangular in a side view. The inner casing 34 has a length in the vertical direction and a length in the left/right direction such that the inner casing 34 can accommodate the sheet feeding unit 6 (see FIG. 1) and the image forming unit 7. The inner casing 34 is accommodated in the outer casing 33 with a gap from the outer casing 33 on the rear side.

Inside the inner casing 34, a drum-unit accommodating part 36 (one example of an accommodating space) is partitioned for accommodating the drum unit 10.

As shown in FIG. 1, the drum-unit accommodating part 36 is formed below the belt unit 20 and has a substantially rectangular shape capable of accommodating the drum unit 10 as seen in a side view.

Further, as shown in FIG. 2, an LED supporting frame 35 for supporting the LED units 12 is provided inside the inner casing 34.

The LED supporting frame 35 is formed in a substantially flat plate shape and is provided above the sheet feed tray 9 so as to partition the internal space of the inner casing 34.

The LED supporting frame 35 is provided with main-body-side guide parts 99 and main-body-side fitting parts 100.

Figure 3:
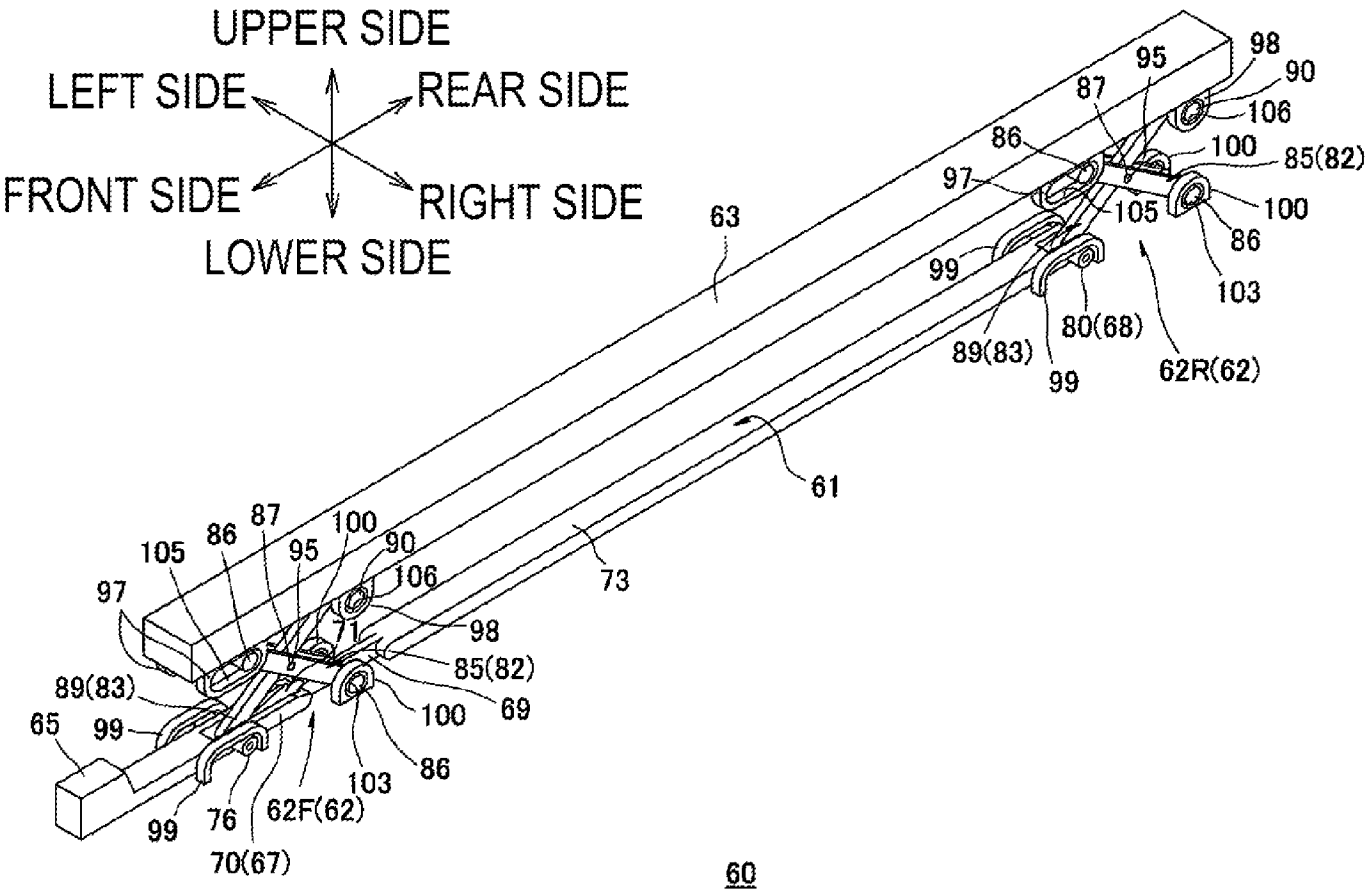
FIG. 3 is a perspective view illustrating a movable mechanism shown in FIG. 2 as seen from the top front side.

As shown in FIG. 3, the main-body-side guide parts 99 include two front main-body-side guide parts 99 and two rear main-body-side guide parts 99. The front main-body-side guide parts 99 are provided at the front portion of the LED supporting frame 35 (see FIG. 2) such that the front main-body-side guide parts 99 face each other in the left/right direction with a gap. The rear main-body-side guide parts 99 are provided at the rear portion of the LED supporting frame 35 (see FIG. 2) such that the rear main-body-side guide parts 99 face each other in the left/right direction with a gap.

Specifically, the front main-body-side guide parts 99 are provided corresponding to first guide bosses 76 (to be described below) of a slide member 61 (one example of a first movable member) (to be described below), and the rear main-body-side guide parts 99 are provided corresponding to second guide bosses 80 (to be described below) of the slide member 61 (to be described below). Further, the front main-body-side guide parts 99 are aligned with the rear main-body-side guide parts 99 in the front/rear direction.

The main-body-side guide parts 99 are formed in a substantially U shape extending in the front/rear direction as seen in a side vide, and free end portions of the main-body-side guide parts 99 are fixed to the top of he LED supporting frame 35.

The inner sides of the main-body-side guide parts 99 are formed such that lengths in the front/rear direction are about three times the outside diameter of each first guide boss 76 (second guide boss 80) (to be described below), and lengths in the vertical direction is substantially the same as the outside diameter of each first guide boss 76 (the second guide boss 80) (to be described below).

Figures 5A, 5B:
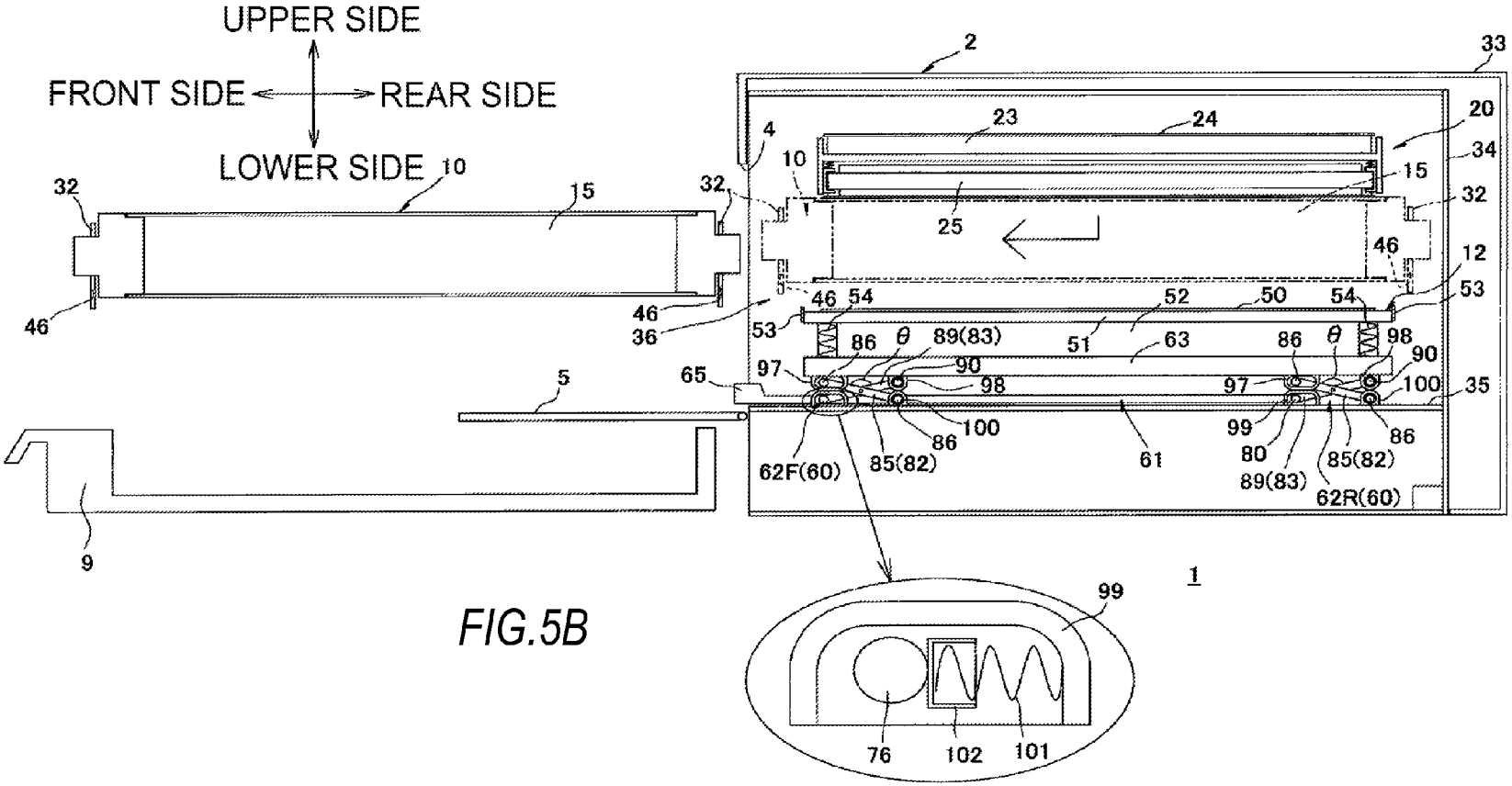
FIG. 5A shows an explanatory view for explaining an operation of pulling (removing) a drum unit shown in FIG. 1 out of (from) a main body casing.
FIG. 5B shows an enlarged view illustrating a main-body-side guide portion.

As shown in FIG. 5B, a compression spring 101 (one example of a pressing member) and a covering part 102 are provided inside the front main-body-side guide part 99 corresponding to the first guide boss 76 (to be described below).

The covering parts 102 are formed in a substantially cylindrical shape extending in the front/rear direction, and the front end portions of the covering parts 102 are closed. The covering parts 102 are disposed to accommodate the front portions of the compression springs 101 therein.

The compression springs 101 are formed in an air-core coil shape extending in the front/rear direction. The rear end portions of the compression springs 101 are fixed to the rear end portions of the main-body-side guide parts 99, and the front end portions of the compression springs 101 are fixed to the rear surfaces of the front walls of the covering parts 102. Incidentally, other compression springs 101 and the covering parts 102 may be provided in the rear main-body-side guide parts 99 corresponding to the second guide bosses 80 (to be described below).

As shown in FIG. 3, the main-body-side fitting parts 100 include two front main-body-side fitting parts 100 and two rear main-body-side fitting parts 100. The front main-body-side fitting parts 100 are provided on the rear side relative to the two front main-body-side guide parts 99, such that the front main-body-side fitting parts 100 face each other in the left/right direction with a gap. The rear main-body-side fitting parts 100 are provided on the rear side relative to the two rear main-body-side guide parts 99, such that the rear main-body-side fitting parts 100 face each other in the left/right direction with a gap.

Specifically, the front main-body-side fitting parts 100 are provided corresponding to rear side first fitting portions 86 (to be described below) of a front movable member 62F (to be described below), and the rear main-body-side fitting parts 100 are provided corresponding to rear side first fitting portions 86 (to be described below) of a rear movable member 62R (to be described below).

The main-body-side fitting parts 100 are formed in a substantially semi-circle arc shape protruding upward from the top of the LED supporting frame 35 as seen in a side view, and formed in a substantially flat plate shape having a thickness in the left/right direction.

Fitting holes 103 are formed at the central portions of the main-body-side fitting parts 100.

The fitting holes 103 are formed in a substantially circular shape as seen in a side view, and are formed to extend in the left/right direction.

The hole diameters of the fitting holes 103 are substantially the same as the outside diameters of the first fitting portions 86 (to be described below).

3 . LED Unit

Each of the LED units 12 includes an LED array 50 (one example of an exposing member), a first frame 51 that supports the LED array 50, a pair of second frames 52 (see FIG. 1) that sandwiches the first frame 51, and a movable mechanism 60 for moving the LED array 50.

(1) LED Array, First frame, and Second Frame

The LED array 50 is disposed at the upper end portions of the LED unit 12. The LED array 50 is formed in a substantially flat plate shape extending in the front/rear direction, and integrally holds a plurality of LEDs arranged in parallel in the front/rear direction. The length of the LED array 50 in the front/rear direction is shorter than the length of the photosensitive drum 15 in the front/rear direction, and is longer than the length of the sheet passing area of the photosensitive drum 15.

The first frame 51 is disposed below the LED array 50. The first frame 51 is formed in a substantially rectangular shape extending in the front/rear direction as seen in a side view. The length of the first frame 51 in the front/rear direction is shorter than the length of the photosensitive drum 15 in the front/rear direction, and is longer than the length of the LED array 50 in the front/rear direction. The upper end portion of the first frame 51 supports the LED array 50.

On the first frame 51, a plurality of (e.g., two) positioning rollers 53 and a plurality of (e.g., two) compression springs 54 are provided.

The plurality of positioning rollers 53 are formed in a substantially circular plate shape, and are supported on both end faces of the corresponding first frame 51 such that the positioning rollers 53 are rotatable. The positioning rollers 53 are provided to protrude slightly upward from the LED array 50, and abut on both end portions of the photosensitive drum 15 from the lower side.

The plurality of compression springs 54 are formed in an air-core coil shape, and are disposed at both end portions of the lower surface of the first frame 51 in the front/rear direction.

The upper end portions of the compression springs 54 are fixed to the lower surface of the corresponding first frame 51, and the lower end portions of the compression springs 54 are fixed to the upper surface of a holding member 63 (to be described below).

As shown in FIGS. 1 and 2, the paired second frames 52 are formed in a substantially flat plate shape extending in the front/rear direction, and are disposed to face each other in the left/right direction with a gap such that the paired second frames 52 sandwich the corresponding first frame 51.

Therefore, the first frame 51 can slide elastically and vertically between the paired second frames 52.

Further, the first frame 51 is always pressed upward by the compression springs 54 such that the positioning roller 53 abuts on the photosensitive drum 15.

Therefore, the LED array 50 is positioned by the positioning roller 53 such that the LED array 50 faces the photosensitive drum 15 from the lower side with gaps (e.g., gaps corresponding to the protruding length of the positioning roller 53).

(2) Movable Mechanism

As shown in FIGS. 2 and 3, the movable mechanism 60 is provided below the pair of second frames 52, that is, below the LED array 50. The movable mechanism 60 includes the holding member 63, the slide member 61, and a movable member 62 (one example of a second movable member).

(2-1) Holding Member

The holding member 63 is formed in a substantially rod shape extending in the front/rear direction. The holding member 63 supports the second frames 52 and the compression springs 54 from the lower side (see FIG. 3). That is, the holding member 63 supports the LED array 50 through the first frame 51 and the second frames 52.

On the lower surface of the holding member 63, LED-side guide parts 97 and LED-side fitting portions 98 are provided.

As shown in FIG. 3, the LED-side guide parts 97 include two front LED-side guide parts 97 and two rear LED-side guide parts 97. The front LED-side guide parts 97 are provided at the front portion of the lower surface of the holding member 63 (see FIG. 2) such that the front LED-side guide parts 97 face each other in the left/right direction with a gap. The rear LED-side guide parts 97 are provided at the rear portion of the lower surface of the holding member 63 (see FIG. 2) such that the rear LED-side guide parts 97 face each other in the left/right direction with a gap.

Specifically, the front LED-side guide parts 97 are provided corresponding to first fitting portions 86 (to be described below) of the front side of the front movable member 62F (to be described below), and the rear LED-side guide parts 97 are provided corresponding to first fitting portions 86 (to be described below) of the front side of the rear movable member 62R (to be described below).

The LED-side guide parts 97 are formed in a substantially rectangular shape protruding downward from the lower surface of the holding member 63 as seen in a side view, and formed in a substantially flat plate shape having a thickness in the left/right direction.

Further, the LED-side guide parts 97 are disposed such that when the LED-side guide parts 97 are projected in the vertical direction, the LED-side guide parts 97 overlap the main-body-side guide parts 99.

Guide holes 105 are formed at the central portions of the LED-side guide parts 97.

The guide holes 105 are formed in a substantially oval shape extending in the front/rear direction as seen in a side view, and extend in the left/right direction.

The major length of each guide hole 105 is about three times the outside diameter of each first fitting portion 86 (to be described below), and the minor diameter of each guide hole 105 is substantially the same as the outside diameter of each first fitting portion 86 (to be described below).

The LED-side fitting portions 98 include two front LED-side fitting portions 98 and two rear LED-side fitting portions 98. The front LED-side fitting portions 98 are provided on the rear side relative to the two front LED-side guide parts 97 such that the front LED-side fitting portions 98 face each other in the left/right direction with a gap. The rear LED-side fitting portions 98 are provided on the rear side relative to the two rear LED-side guide parts 97 such that the rear LED-side fitting portions 98 face each other in the left/right direction with a gap (see FIG. 2).

Specifically, the front LED-side fitting portions 98 are provided corresponding to both end portions of a second fitting portion 90 (to be described below) of the front movable member 62F (to be described below) in the left/right direction, and the rear LED-side fitting portions 98 are provided corresponding to both end portions of a second fitting portion 90 (to be described below) of the rear movable member 62R (to be described below) in the left/right direction.

The LED-side fitting portions 98 are formed in a substantially semi-circle arc shape bulging downward from the lower surface of the holding member 63 as seen in a side view, and formed in a substantially flat plate shape having a thickness in the left/right direction.

The LED-side fitting portions 98 are disposed such that when the LED-side fitting portions 98 are projected in the vertical direction, the LED-side fitting portions 98 overlap the main-body-side fitting parts 100.

Fitting holes 106 are formed at the central portions of the LED-side fitting portions 98.

The fitting holes 106 are formed in a substantially circular shape as seen in a side view, and extend in the left/right direction.

The hole diameters of the fitting holes 106 are substantially the same as the outside diameters of the second fitting portions 90 (to be described below).

(2-2) Slide Member

The slide member 61 is formed in a substantially rod shape extending in the front/rear direction. The slide member 61 is disposed on the upper surface of the LED supporting frame 35 such that the slide member 61 is slidable along the front/rear direction with respect to the main body casing 2.

Figure 4:
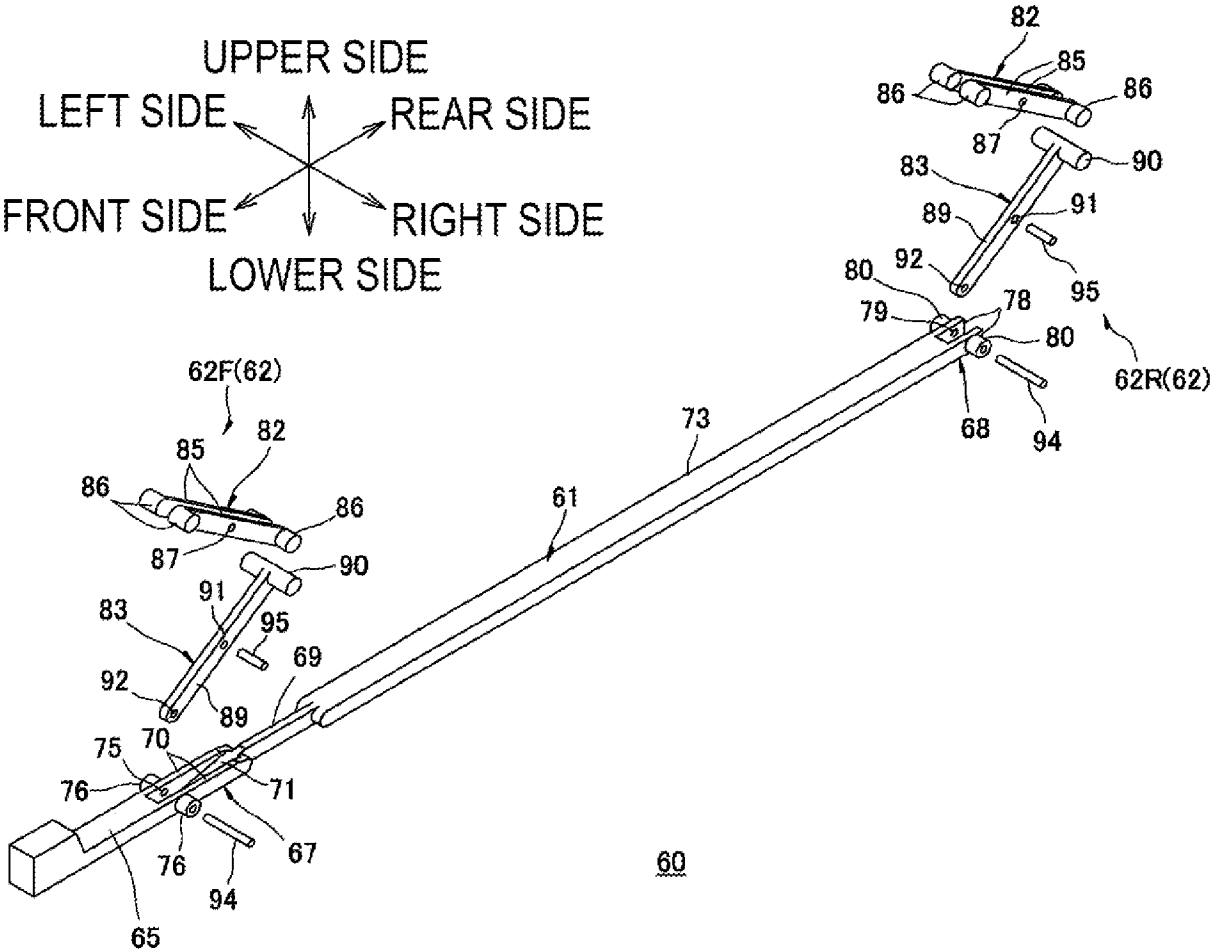
FIG. 4 is an exploded perspective view illustrating the movable mechanism shown in FIG. 3.

Specifically, as shown in FIG. 4, the slide member 61 integrally includes a pressed portion 65, a first engagement portion 67, a connection portion 69, a main body portion 73, and a second engagement portion 68.

The pressed portion 65 is provided at the front end portion of the slide member 61, and is formed in a substantially L shape in a side view.

The first engagement portion 67 is provided continuously on the rear side of the pressed portion 65 such that the first engagement portion 67 corresponds to the front end portion of a second link member 83 (to be described below) of the front movable member 62F (to be described below).

The first engagement portion 67 includes a pair of first supporting portions 70 and an inclined portion 71.

The paired first supporting portions 70 are formed from both end portions of the rear end portion of the pressed portion 65 in the left/right direction, formed in a substantially flat plate shape protruding toward the rear side, and are disposed to face each other in the left/right direction with a gap.

Each of the paired first supporting portions 70 includes an insertion hole 75 and first guide bosses 76 formed at the front end portion of the corresponding first supporting portion 70.

The insertion holes 75 are formed in substantially circular shapes facing each other in a side view, and extend in the left/right direction. The hole diameters of the insertion holes 75 are substantially the same as the outside diameter of an insertion shaft 94 (to be described below).

The first guide bosses 76 are formed in a substantially cylindrical shape protruding outward in the left/right direction from the circumferential end portions of the insertion holes 75.

The inclined portion 71 is provided between the paired first supporting portions 70 on the rear side relative to the insertion hole 75 (the first guide bosses 76), and is formed in a substantially triangular shape in a side view. Specifically, the upper surface of the inclined portion 71 is formed to be inclined upward as it goes to the rear side.

The connection portion 69 is formed in a substantially flat plate shape extending from the rear end portion of the inclined portion 71 toward the rear side, and has a section shape extending in the vertical direction.

The main body portion 73 is formed in a substantially rod shape extending in the front/rear direction, and formed in a substantially semi-circle arc shape such that the front end portion of the main body portion 73 bulges toward the front side as seen in a side view. The central portion of the front end portion of the main body portion 73 in the left/right direction is connected to the rear end portion of the connection portion 69.

The second engagement portion 68 is provided continuously from the rear side of the main body portion 73 such that the second engagement portion 68 corresponds to the front end portion of the second link member 83 (to be described below) of the rear movable member 62R (to be described below).

The second engagement portion 68 includes a pair of second supporting portions 78.

The paired second supporting portions 78 are formed from both end portions of the rear end portion of the main body portion 73 in the left/right direction, formed in a substantially flat plate shape protruding toward the rear side, and are disposed to face each other in the left/right direction with a gap.

Each of the paired second supporting portions 78 includes an insertion hole 79 and a second guide boss 80 formed at the front end portion of the corresponding second supporting portion 78.

The insertion holes 79 are formed in substantially circular shapes facing each other in a side view, and extend in the left/right direction.

The second guide bosses 80 are formed in a substantially cylindrical shape protruding outward in the left/right direction from the circumferential end portions of the insertion holes 79. The outside diameters of the second guide bosses 80 are substantially the same as the outside diameters of the first guide bosses 76.

(2-3) Movable Members

As shown in FIG. 2, the movable member 62 has a pantograph mechanism. The movable member 62 includes a front movable member 62 (hereinafter, referred to as a movable member 62F) and a rear movable member 62 (hereinafter, referred to as a movable member 62R).

The front movable member 62F is provided such that when the front movable member 62F is projected in the vertical direction, the front movable member 62F overlaps the front end portion of the LED array 50. The rear movable member 62R is provided such that when the rear movable member 62R is projected in the vertical direction, the rear movable member 62R overlaps the rear end portion of the LED array 50. That is, the two movable members 62 are provided to support both end portions of the LED array 50 in the front/rear direction, through both end portions of the holding member 63 (to be described below), respectively.

As shown in FIG. 4, each of the movable members 62 includes a pair of first link members 82 and a second ring member 83.

The paired first link members 82 are disposed to face each other in the left/right direction with a gap.

Each of the paired first link members 82 is formed in a substantially U shape open outward in the left/right direction as seen in a plan view, and includes a first flat plate portion 85 and two first fitting portions 86.

The first flat plate portions 85 are formed in a substantially flat plate shape, and have section shapes extending in the vertical direction. Through-holes 87 are formed at the central portions of the first flat plate portions 85.

The through-holes 87 are formed in a substantially circular shape in a side view, and extend in the left/right direction. The hole diameters of the through-holes 87 are substantially the same as the outside diameter of a corresponding shaft part 95 (to be described below).

The two first fitting portions 86 are provided at both end portions of the corresponding first flat plate portion 85 in the front/rear direction, and are formed in a substantially cylindrical shape protruding outward in the left/right direction from the outer face of the corresponding first flat plate portion 85 in the left/right direction.

The second ring member 83 is formed in a substantially T shape in a plan view, and includes a second flat plate portion 89 and the second fitting portion 90.

The second flat plate portion 89 is formed in a substantially flat plate shape, and has a section shape extending in the vertical direction. The length of the second flat plate portion 89 in a longitudinal direction is substantially the same as the length of each first flat plate portion 85 in the longitudinal direction.

A through-hole 91 and an insertion hole 92 are formed at the second flat plate portion 89.

The through-hole 91 is formed in a circular shape in a side view such that the through-hole 91 passes through the central portion of the second flat plate portion 89. The hole diameter of the through-hole 91 is slightly larger than the outside diameter of the shaft part 95 (to be described below).

The insertion hole 92 is formed in a substantially circular shape in a side view such that the insertion hole 92 passes through the front end portion of the second flat plate portion 89. The hole diameter of the insertion hole 92 is slightly larger than the outside diameter of the insertion shaft 94 (to be described below).

The second fitting portion 90 is formed in a substantially cylindrical shape extending in the left/right direction, and the central portion of the lower front side of the second fitting portion 90 in the left/right direction is connected to the rear end portion of the second flat plate portion 89.

As shown in FIG. 3, one pair of first link members 82 and the second link member 83 are disposed such that the second flat plate portion 89 is disposed between the first flat plate portions 85 and intersect with the first flat plate portions 85 in the form of an X, and then a shaft part 95 having a substantially cylindrical shape is inserted into the two through-holes 87 and the through-hole 91, whereby the first flat plate portions 85 and the second link member 83 are connected so as to be rotatable with respect to each other (see FIG. 4). That is, the pair of first link members 82 and second link member 83 intersect with each other and are pivotably supported by the shaft part 95 such that the first link members 82 and second link member 83 are rotatably on each other.

The front end portion of the second flat plate portion 89 of the front movable member 62F is disposed between the paired first supporting portions 70. An insertion shaft 94 having a substantially cylindrical shape is inserted into the two first guide bosses 76, the two insertion holes 75, and the insertion hole 92. Accordingly, the front end portion of the second flat plate portion 89 is fixed to the first engagement portion 67 such that the front end portion of the second flat plate portion 89 and the first engagement portion 67 are rotatable with respect to each other. Further, in the front movable member 62F, the rear end portions of the paired first flat plate portions 85 are disposed to sandwich the connection portion 69 from both sides in the left/right direction.

The front end portion of the second flat plate portion 89 of the rear movable member 62R is disposed between the paired second supporting portions 78. An insertion shaft 94 having a substantially cylindrical shape is inserted into the two second guide bosses 80, the two insertion holes 79, and the insertion hole 92, whereby the front end portion of the second flat plate portion 89 is fixed to the second engagement portion 68 such that the front end portion of the second flat plate portion 89 and the second engagement portion 68 are rotatable with respect to each other.

In this way, the front end portions of the two second link members 83 are fixed to the slide member 61 such that the two second link members 83 and the slide member 61 are rotatable with respect to each other, and the front movable member 62F and the rear movable member 62R are connected to the slide member 61.

The slide member 61 and the movable members 62 are held by the holding member 63 and the LED supporting frame 35 as shown in FIG. 2.

Specifically, while the first fitting portions 86 of the front sides (upper sides) of the first link members 82 are fit into the guide holes 105 of corresponding LED-side guide parts 97 from the inner side, the first fitting portions 86 of the rear sides (lower sides) of the first link members 82 are fit into the fitting holes 103 of corresponding main-body-side fitting parts 100 from the inner side.

In this way, the front-side first fitting portions 86 are held by the LED-side guide parts 97 such that the front-side first fitting portions 86 are movable in the front/rear direction and the front-side first fitting portions 86 and the LED-side guide parts 97 are rotatable with respect to each other, and the rear-side first fitting portions 86 are fixed to the main-body-side fitting parts 100 such that the rear-side first fitting portions 86 and the main-body-side fitting parts 100 are rotatable with respect to each other.

That is, the rear end portions of the two first link members 82 are fixed to the main body casing 2 such that the two first link members 82 and the main body casing 2 are rotatable with respect to each other, and the front end portions of the two first link members 82 are held by the holding member 63 such that the two first link members 82 are movable in the front/rear direction and the two first link members 82 and the holding member 63 are rotatable with respect to each other.

Further, the first guide bosses 76 and the second guide bosses 80 of the slide member 61 are fit into corresponding main-body-side guide parts 99 from the inner side in the left/right direction, and both end portions of the second fitting portion 90 of each second link member 83 in the left/right direction are fit into corresponding fitting holes 106 of a corresponding LED-side fitting portion 98 from the inner side in the left/right direction.

In this way, the first guide bosses 76 and the second guide bosses 80 are held by the main-body-side guide parts 99 such that the first guide bosses 76 and the second guide bosses 80 are movable along the front/rear direction, and both end portions of each second fitting portion 90 in the left/right direction are fixed to corresponding LED-side fitting portions 98 such that the second fitting portion 90 is relatively rotatable.

That is, the rear end portions of the two second link members 83 are fixed to the holding member 63 such that the two second link members 83 and the holding member 63 are rotatable with respect to each other, and the front end portions of the two second link members 83 are held to be movable in the front/rear direction with respect to the main body casing 2.

In this way, the front and rear end portions of the holding member 63 are supported from the lower side by the front movable member 62F and the rear movable member 62R, respectively.

The slide member 61 is provided to be slidable along the front/rear direction between a first position (see FIG. 2) and a second position (see FIG. 5A). In a state where the front cover 5 is at a closed position, the slide member 61 is at the first position, and the front end portion of the pressed portion 65 abuts on the rear surface of the front cover 5. Further, in a state where the front cover 5 is in an open position, the slide member 61 is at the second position, and the front end portion of the pressed portion 65 protrudes outward from the main body casing 2. That is, the slide member 61 is slidable along the front/rear direction in accordance with the opening/closing operation of the front cover 5.

As shown in FIG. 5B, the compression springs 101 press the first guide bosses 76 (the second guide bosses 80) toward the front side through the covering parts 102, whereby the slide member 61 is always pressed toward the front side such that the slide member 61 is disposed at the second position. That is, the compression springs 101 press the slide member 61 from the first position toward the second position.

Further, as shown in FIG. 2, in a state where the slide member 61 is at the first position, the movable members 62 are disposed at rising positions such that the first flat plate portions 85 and the second flat plate portions 89 form intersection angles θ (angles formed on the holding member (63) side) of, for example, 60° to 120°. At this time, the LED array 50 is disposed at exposure positions close to the photosensitive drum 15 such that the positioning roller 53 abuts on the photosensitive drum 15 and the LED array 50 exposes the photosensitive drum 15.

Further, in a state where the slide member 61 is at the second position, the movable members 62 are disposed at tilting positions where the movable members 62 are tilted toward the LED supporting frame (35) side such that the intersection angles θ are larger than those at the rising positions. At this time, the LED array 50 is disposed at the evacuation position (see FIG. 5A) such that the positioning roller 53 is distant from the photosensitive drum 15 and the LED array 50 is evacuated from the photosensitive drum 15.

That is, in accordance with the sliding of the slide member 61, the movable member 62 moves the LED array 50 between the exposure position and the evacuation position.

Incidentally, the intersection angles θ at the tilting positions are, for example, 140° to 170°. Further, at the tilting positions, the lower end portion of the second flat plate portion 89 of the front movable member 62F is in contact with the inclined portion 71.

4 . Mount and Removal of Drum unit with Respect to Main Body Casing

Now, mount and removal of the drum unit 10 with respect to the main body casing 2 will be described.

As shown in FIG. 2, in a state where the front cover 5 is at the closed position, the pressed portion 65 are pressed toward the rear side against the pressing forces of the compression springs 101 (see FIG. 5B) by the rear surface of the front cover 5, whereby the slide member 61 is disposed at the first position.

At this time, the movable member 62 is disposed at the rising position, and the LED array 50 is disposed at the exposure position.

After the drum unit 10 is mounted in the main body casing 2, in order to pull (remove) the drum unit 10 out of (from) the main body casing 2, as shown in FIG. 5A, first, the front cover 5 is moved from the closed position (see FIG. 2) to the open position, whereby the main opening 4 is opened such that the drum-unit accommodating part 36 and the outside of the main body casing 2 are connected through the main opening 4.

Then, the pressing of the front cover 5 on the slide member 61 is released, and the first guide bosses 76 are pressed toward the front side by the pressing forces of the compression springs 101, whereby the first guide bosses 76 and the second guide bosses 80 are guided along the front/rear direction by corresponding main-body-side guide parts 99. Therefore, the slide member 61 is moved toward the front side and slides along the front/rear direction from the first position to the second position.

In this case, the front end portion of the second flat plate portion 89 of the front movable member 62F is moved toward the front side with movement of the first guide bosses 76, and the front end portion of the second flat plate portion 89 of the rear movable member 62R is moved toward the front side with movement of the second guide bosses 80.

Then, the front-side first fitting portions 86 of the first link members 82 are moved toward the front side while rotating with respect to the LED-side guide parts 97, in corresponding guide holes 105 (see FIG. 3).

At this time, the rear-side first fitting portions 86 rotate inside corresponding fitting holes 103 (see FIG. 3), and the second fitting portions 90 of the second link members 83 rotate inside corresponding fitting holes 106 (see FIG. 2).

In this way, the movable members 62 are moved from the rising positions to the tilting positions.

Then, the front movable members 62F and the rear movable members 62R move the front end portion and rear end portion of the LED array 50 toward the lower side, respectively, at the same time. According thereto, the movable members 62 move the front and rear end portions of the LED array 50 at the same time, so as to move the LED array 50 in parallel from the exposure position to the evacuation position.

That is, the slide member slides in accordance with the movement of the front cover 5 from the closed position to the open position, and the LED array 50 moves from the exposure position to the evacuation position in accordance with the sliding of the slide member 61.

Thereafter, when a user applies a force to pull the drum unit 10 toward the front side, the drum unit 10 moves downward, moves toward the front side, and is pulled out of the drum-unit accommodating part 36 along the front/rear direction through the main opening 4. At this time, the drum unit 10 is moved such that the mount/removal grooves 46 of the drum frames 32 pass the upper end portions of the developing units 11.

Then, when the user further pulls the drum unit 10 toward the front side, the drum unit 10 is removed from the main body casing 2.

Therefore, the removal of the drum unit 10 from the main body casing 2 is completed.

Subsequently, mount of the drum unit 10 into the main body casing 2 will be described.

In order to mount the drum unit 10 into the drum-unit accommodating part 36 of the main body casing 2, an operation is performed in a reverse procedure to that of the above-mentioned pullout (removal) operation.

Specifically, as shown in FIG. 5A, the drum unit 10 is inserted toward the drum-unit accommodating part 36 through the main opening 4, and is accommodated in the drum-unit accommodating part 36.

Next, the front cover 5 is moved from the open position to the closed position.

Then, as shown in FIG. 2, the pressed portion 65 of the slide member 61 is pressed by the front cover 5, whereby the slide member 61 is moved from the second position to the first position.

At this time, in accordance with the movement of the slide member 61 from the second position to the first position, the movable members 62 move from the tilting positions to the rising positions.

Then, the front movable member 62F and the rear movable member 62R move the front end portion and rear end portion of the LED array 50 toward the upper side, respectively, at the same time. In this way, the movable members 62 move the LED array 50 in parallel from the evacuation positions to the exposure positions.

In this case, at the exposure positions, the positioning rollers 53 of the first frames 51 abut on the circumferential surfaces of the photosensitive drums 15, and the LED array 50 is positioned with respect to the photosensitive drum 15.

That is, in accordance with the movement of the front cover 5 from the open position to the closed position, the slide member 61 slides, and the LED array 50 moves from the evacuation position to the exposure position in accordance with the sliding of the slide member 61.

Therefore, the mount of the drum unit 10 into the main body casing 2 is completed.

5 . Advantages (1) The printer 1 according to the exemplary embodiment of the present invention includes the movable member 62 in addition to the slide member 62, as shown in FIG. 2. Therefore, so long as the movable member 62 secures an amount of movement of the slide member 61 corresponding to an amount of displacement of the LED array 50 between the exposure positions and the evacuation positions, it is possible to surely move the LED array 50 between the exposure position and the evacuation position.

Therefore, it is possible to reduce the amount of movement of the slide member 61, as compared to a configuration without the movable member 62.

As a result, it is possible to surely move the LED array 50 between the exposure position and the evacuation position, and to reduce a size of the printer 1.

Further, the movable member 62 includes the front movable member 62F and the rear movable member 62R, and when the movable member 62 moves the LED array 50, the front movable member 62F and the rear movable member 62R move the front end portion and rear end portion of the LED array 50, respectively, at the same time.

Therefore, the movable member 62 can move the front and rear end portions of the LED array 50 at the same time.

As a result, it is possible to move the LED array 50 in parallel, and to prevent the LED array 50 from getting kinked.

Therefore, it is possible to suppress the LED array 50 from being damaged, and to prevent undesirable contact of the LED array 50 with the photosensitive drums 15.

Further, when the movable member 62 moves the LED array 50 from the evacuation position to the exposure position, it is possible to surely make the positioning roller 53 abut on the photosensitive drum 15. Therefore, it is possible to improve the accuracy of relative positioning of the photosensitive drum 15 and the LED array 50 at the exposure position.

Further, the slide member 61 slides along the front/rear direction, whereby the movable mechanism 60 moves the LED array 50 between the exposure position and the evacuation position. Therefore, it is possible to reduce interruption of the movable mechanism 60 when the drum unit 10 or the developing unit 11 is mounted into or removed from the main body casing 2 along the front/rear direction (e.g., the axial direction of the photosensitive drum 15).

(2) The LED array 50 is disposed to face the photosensitive drum 15 from the lower side, and the movable mechanism 60 is provided below the LED array 50.

Therefore, in a case where the movable member 62 moves the LED array 50 from the exposure position to the evacuation position as shown in FIG. 5A, it is possible to surely position the LED array 50 at the evacuation position by gravity.

On the other hand, in a case where the movable member 62 moves the LED array 50 from the evacuation position to the exposure position as shown in FIG. 2, since the movable member 62 is provided to support both end portions of the LED array 50, it is possible to surely position the LED array 50 at the exposure position against gravity.

Therefore, it is possible to surely move the LED array 50 between the exposure position and the evacuation position.

As shown in FIG. 5A, since the movable mechanism 60 is disposed across the LED array 50 from the photosensitive drum 15, the movable mechanism 60 is sufficiently distant from the pullout track of the drum unit 10 from the main body casing 2. Therefore, during the operation of pulling the drum unit 10 out of the main body casing 2, it is possible to suppress interference between the drum unit 10 and the movable mechanism 60, and to smoothly pull the drum unit 10 out of the main body casing 2.

Further, since the movable mechanism 60 is disposed across the LED array 50 from the photosensitive drum 15, it is possible to narrow the intervals between adjacent developing units 11 (see FIG. 1).

Therefore, it is possible to reduce the size of the printer 1 in the arrangement direction of the plurality of (e.g., four) developing units 11, that is, the left/right direction.

(3) As shown in FIG. 1, the plurality of (e.g., four) photosensitive drums 15 are provided corresponding to multiple colors (black, yellow, magenta, and cyan) and are arranged at intervals in the left/right direction.

Therefore, it is possible to form full color images.

Further, since the slide member 61 slides along the front/rear direction, whereby the movable mechanism 60 moves the LED array 50 between the exposure position and the evacuation position, it becomes unnecessary to secure a space for moving the LED array 50 in the left/right direction.

Therefore, it is possible to narrow intervals between axes of adjacent photosensitive drums 15, to form full color images, and to further downsize the printer 1.

(4) The slide member 61 is slidable between the first position which is the position of the slide member 61 in a state where the front cover 5 is at the closed position as shown in FIG. 2 and the second position which is the position of the slide member 61 in a state where the front cover 5 is at the open position as shown in FIG. 5A. Further, the main-body-side guide part 99 includes the compression spring 101 configured to press the slide member 61 from the first position toward the second position as shown in FIG. 5B.

Therefore, it is possible to simplify the configuration of the printer 1, and to surely make the slide member 61 slide between the first position and the second position in accordance with the opening/closing operation of the front cover 5.

As a result, it is possible to surely link the opening/closing operation of the front cover 5 and the sliding of the slide member 61.

(5) The movable mechanism 60 includes the holding member 63 for holding the LED array 50 as shown in FIG. 2. Further, the movable member 62 includes one pair of first link members 82 and a second link member 83 as shown in FIG. 3. The pair of first link members 82 and the second link member 83 are disposed to intersect with each other such that the second flat plate portion 89 is disposed between paired first flat plate portions 85, and form an X shape together with the paired first flat plate portions 85, and then a shaft part 95 having a substantially cylindrical shape is inserted into the two through-holes 87 and the through-hole 91, whereby the pair of first link members 82 and second link member 83 are connected to be rotatable with respect to each other (see FIG. 4)

Further, as shown in FIG. 2, in a state where the slide member 61 is at the first position, the movable member 62 is disposed at rising positions such that the first flat plate portions 85 and the second flat plate portions 89 form intersection angles θ (angles formed on the holding member (63) side) of, for example, 60° to 120°. Meanwhile, in a state where the slide member 61 is at the second position, the movable member 62 is disposed at tilting positions where the movable member 62 is tilted toward on the LED supporting frame (35) side such that the intersection angles θ are larger than those at the rising positions.

Therefore, in accordance with the movement of the front cover 5 from the closed position to the open position, the slide member 61 slides, and in accordance with the sliding of the slide member 61, the movable member 62 moves from the tilting position to the rising position, thereby moving the LED array 50 from the exposure position to the evacuation position.

On the other hand, the slide member 61 slides in accordance with the movement of the front cover 5 from the open position to the closed position, and the LED array 50 moves from the evacuation position to the exposure position in accordance with the sliding of the slide member 61.

As a result, it is possible to secure a larger amount of displacement of the movable member 62 with respect to the amount of movement of the slide member 61.

Therefore, even if the amount of movement of the slide member 61 is reduced, it is possible to surely move the LED array 50 between the exposure position and the evacuation position, and thus it is possible to further reduce the size of the printer 1.

Further, the front movable member 62F and the rear movable member 62R are provided to support the front and rear end portions of the LED array 50 through the front and rear end portions of the holding member 63, respectively. That is, the front and rear end portions of the holding member 63 are supported from the lower side by the front movable member 62F and the rear movable member 62R, respectively.

Therefore, it is unnecessary to additionally provide members other than the holding member 63 for supporting the LED array 50 (or simplification is possible). As a result, it is possible to reduce the number of components, and to reduce the size of the printer 1, specifically, reduce the size of the printer 1 in the left/right direction.

The invention claimed is:

1. An image forming apparatus comprising:

a main apparatus body having an accommodating space partitioned therein and an opening connecting the accommodating space and an outside;

a drum unit comprising a photosensitive drum configured to carry a developer image and accommodated in the accommodating space;

an opening/closing member configured to rotate between an open position for opening the opening and a closed position for closing the opening, a rotation axis of the opening/closing member extending in a first direction perpendicular to an axial direction of the photosensitive drum;

an exposing member extending in a second direction parallel to the axial direction of the photosensitive drum and configured to expose the photosensitive drum to form a latent image thereon; and a movable mechanism comprising:

a first movable member configured to contact the opening/closing member and move in accordance with an opening/closing operation of the opening/closing member;

a second movable member configured to move the exposing member between an exposure position close to the photosensitive drum and a separated position separated from the photosensitive drum, the exposing member in the separated position being closer to the first movable member than the exposing member in the exposure position; and a restricting member including link members which restrict the exposing member from being moved in the axial direction of the photosensitive drum when the exposing member moves between the separated position and the exposure position, wherein the second movable member is configured to move the exposing member from the exposure position to the separated position by moving the first movable member in accordance with movement of the opening/closing member from the closed position to the open position, wherein the second movable member is configured to move the exposing member from the separated position to the exposure position by moving the first movable member in accordance with the movement of the opening/closing member from the open position to the closed position, wherein the first movable member is configured to slide along the axial direction of the photosensitive drum in accordance with an opening/closing operation of the opening/closing member.

2. The image forming apparatus according to claim 1, wherein the exposing member is disposed so as to face the photosensitive drum from a lower side, and wherein the movable mechanism is provided below the exposing member.

3. The image forming apparatus according to claim 1, wherein a plurality of photosensitive drums corresponding to multiple colors is provided including the photosensitive drum such that one of the plurality of photosensitive drums is arranged in parallel with an adjacent one of the plurality of photosensitive drums with an interval therebetween.

4. The image forming apparatus according to claim 1, wherein the first movable member is configured to move between a first position where the first movable member is disposed when the opening/closing member is disposed at the closed position and a second position where the first movable member is disposed in a state where the opening/closing member is disposed at the open position, and wherein the main apparatus body comprises a pressing member configured to press the first movable member from the first position toward the second position.

5. The image forming apparatus according to claim 4, wherein the first movable member is configured to contact the opening/closing member with receiving a pressing force from the pressing member when the first movable member is disposed at the first position.

6. The image forming apparatus according to claim 1, wherein the first movable member comprises a guide boss, and wherein the main apparatus body comprises:

a guide part configured to guide the guide boss in the axial direction of the photosensitive drum; and a pressing member configured to press the guide boss in the axial direction of the photosensitive drum.

7. The image forming apparatus according to claim 1, wherein the first movable member comprises a contact portion, and wherein the first movable member is configured to move in accordance with an opening/closing operation of the opening/closing member in response to the contact portion contacting the opening/closing member.

8. The image forming apparatus according to claim 1, wherein the first movable member is configured to move in a direction parallel to the second direction, the second direction being parallel to the axial direction of the photosensitive drum.

9. The image forming apparatus according to claim 1, wherein the drum unit is configured be pulled out of the accommodating space along the axial direction of the photosensitive drum.

10. The image forming apparatus according to claim 1, wherein the second movable member is configured to move the exposing member from the exposure position down to the separated position by moving the first movable member in accordance with the movement of the opening/closing member from the closed position to the open position, and wherein the second movable member is configured to move the exposing member from the separated position up to the exposure position by moving the first movable member in accordance with the movement of the opening/closing member from the open position to the closed position.

11. The image forming apparatus according to claim 1, wherein the second movable member is configured to move the exposing member from the exposure position down to the separated position by a slide movement of the first movable member in the second direction along the axial direction of the photosensitive drum in accordance with the movement of the opening/closing member from the closed position to the open position, wherein the second movable member is configured to move the exposing member from the separated position up to the exposure position by the slide movement of the first movable member in a third direction, which is opposite to the second direction, along the axial direction of the photosensitive drum in accordance with the movement of the opening/closing member from the open position to the closed position.

12. The image forming apparatus according to claim 11, wherein the drum unit is configured to be moved into the accommodating space from the outside in the second direction through the opening.

13. An image forming apparatus comprising:

a main apparatus body having an accommodating space partitioned therein and an opening connecting the accommodating space and an outside;

a drum unit comprising a photosensitive drum configured to carry a developer image and accommodated in the accommodating space;

an opening/closing member configured to rotate between an open position for opening the opening and a closed position for closing the opening, a rotation axis of the opening/closing member extending in a first direction perpendicular to an axial direction of the photosensitive drum;

an exposing member extending in a second direction parallel to the axial direction of the photosensitive drum and configured to expose the photosensitive drum to form a latent image thereon; and a movable mechanism comprising:

a first movable member configured to contact the opening/closing member and move in accordance with an opening/closing operation of the opening/closing member; and a second movable member configured to move the exposing member between an exposure position close to the photosensitive drum and a separated position separated from the photosensitive drum, the exposing member in the separated position being closer to the first movable member than the exposing member in the exposure position, wherein the second movable member is configured to move the exposing member from the exposure position to the separated position by moving the first movable member in accordance with movement of the opening/closing member from the closed position to the open position, wherein the second movable member is configured to move the exposing member from the separated position to the exposure position by moving the first movable member in accordance with the movement of the opening/closing member from the open position to the closed position, wherein the first movable member comprises a guide boss, and wherein the main apparatus body comprises:

a guide part configured to guide the guide boss in the axial direction of the photosensitive drum; and a pressing member configured to press the guide boss in the axial direction of the photosensitive drum.

14. An image forming apparatus comprising:

a main apparatus body having an accommodating space partitioned therein and an opening connecting the accommodating space and an outside;

a drum unit comprising a photosensitive drum configured to carry a developer image and accommodated in the accommodating space;

an opening/closing member configured to rotate between an open position for opening the opening and a closed position for closing the opening, a rotation axis of the opening/closing member extending in a first direction perpendicular to an axial direction of the photosensitive drum;

an exposing member extending in a second direction parallel to the axial direction of the photosensitive drum and configured to expose the photosensitive drum to form a latent image thereon; and a movable mechanism comprising:

a first movable member configured to contact the opening/closing member and move in accordance with an opening/closing operation of the opening/closing member; and a second movable member configured to move the exposing member between an exposure position close to the photosensitive drum and a separated position separated from the photosensitive drum, the exposing member in the separated position being closer to the first movable member than the exposing member in the exposure position; and wherein the second movable member is configured to move the exposing member from the exposure position to the separated position by moving the first movable member in accordance with movement of the opening/closing member from the closed position to the open position, wherein the second movable member is configured to move the exposing member from the separated position to the exposure position by moving the first movable member in accordance with the movement of the opening/closing member from the open position to the closed position, and wherein the first movable member is configured to slide in a direction parallel to the second direction, the second direction being parallel to the axial direction of the photosensitive drum.

15. The image forming apparatus according to claim 14, wherein the first movable member is configured to slide along the axial direction of the photosensitive drum in accordance with an opening/closing operation of the opening/closing member.

* * * * *